US012564246B2

(12) United States Patent
Chang

(10) Patent No.: US 12,564,246 B2
(45) Date of Patent: Mar. 3, 2026

(54) SHOE HAVING RESILIENT HEEL

(71) Applicant: LEGO STONE CO., LTD., Taichung (TW)

(72) Inventor: Chung-Hao Chang, Taichung (TW)

(73) Assignee: LEGO STONE CO., LTD., Taichung (TW)

( * ) Notice: Subject to any disclaimer, the term of this patent is extended or adjusted under 35 U.S.C. 154(b) by 2 days.

(21) Appl. No.: 18/637,182

(22) Filed: Apr. 16, 2024

(65) Prior Publication Data

US 2025/0134210 A1 May 1, 2025

(30) Foreign Application Priority Data

Oct. 27, 2023 (TW) ..... 112141319

(51) Int. Cl.

| | |
|---|---|
| ***A43B 11/00*** | (2006.01) |
| ***A43B 17/10*** | (2006.01) |
| ***A43B 21/26*** | (2006.01) |
| ***A43B 21/54*** | (2006.01) |
| ***A43B 23/02*** | (2006.01) |
| ***A43B 23/17*** | (2006.01) |

(52) U.S. Cl.

CPC ..... *A43B 21/26* (2013.01); *A43B 11/00* (2013.01); *A43B 17/107* (2013.01); *A43B 21/54* (2013.01); *A43B 23/022* (2013.01); *A43B 23/0235* (2013.01); *A43B 23/17* (2013.01)

(58) Field of Classification Search

CPC ... A43B 11/00; A43B 23/0235; A43B 23/088; A43B 23/14; A43B 23/16; A43B 23/17

See application file for complete search history.

(56) References Cited

U.S. PATENT DOCUMENTS

| | | | | |
|---|---|---|---|---|
| 4,559,722 | A * | 12/1985 | Norton | A43B 23/0235 36/105 |
| 2012/0096742 | A1* | 4/2012 | Shim | A43B 23/17 36/45 |
| 2016/0095383 | A1* | 4/2016 | Surace | A43B 23/088 36/93 |
| 2020/0205511 | A1* | 7/2020 | Hopkins | A43B 11/02 |
| 2020/0359745 | A1* | 11/2020 | Tresser | A43B 7/24 |
| 2022/0225726 | A1* | 7/2022 | Wang | A43B 23/07 |
| 2022/0240625 | A1* | 8/2022 | Shin | A43B 23/028 |
| 2023/0148709 | A1* | 5/2023 | Bidal | A43B 23/026 36/69 |
| 2023/0284748 | A1* | 9/2023 | Weeks | A43B 3/242 |
| 2024/0225176 | A1* | 7/2024 | Munger | A43B 11/00 |
| 2024/0251907 | A1* | 8/2024 | Dean | A43C 11/00 |
| 2025/0064171 | A1* | 2/2025 | Cheney | A43B 3/242 |

* cited by examiner

*Primary Examiner* — Sharon M Prange
(74) *Attorney, Agent, or Firm* — HSML P.C.

(57) ABSTRACT

A shoe includes a sole unit, an upper unit, a sockliner unit, a heel counter and an adhesive layer. The sole unit includes a sole heel sidewall. The upper unit has an access opening edge and an upper heel portion that abuts against the sole heel sidewall. The sockliner unit has a sockliner heel portion that corresponds to the upper heel portion. The heel counter is resiliently deformable and includes a resilient heel plate. The resilient heel plate has a pressing portion and two wing portions. The pressing portion has a pressing body top edge that is adjacent to the access opening edge, and a pressing body bottom edge that is adjacent to the sole unit. The pressing body bottom edge is lower than a top edge of the sole heel sidewall along a height direction.

9 Claims, 17 Drawing Sheets

SHOE HAVING RESILIENT HEEL

CROSS-REFERENCE TO RELATED APPLICATION

This application claims priority to Taiwanese Invention Patent Application No. 112141319, filed on Oct. 27, 2023, the entire disclosure of which is incorporated by reference herein.

FIELD

The disclosure relates to a shoe, and more particularly to a shoe having a resilient heel.

BACKGROUND

Referring to FIGS. 1 to 3, a conventional shoe includes an upper 1, a sockliner 2 disposed inside the upper 1, a sole 3 fixedly disposed on a bottom of the upper 1, and a heel counter 4 disposed between a heel portion of the upper 1 and a heel portion of the sockliner 2. The heel counter 4 supports the heel portions of the upper 1 and the sockliner 2 and prevents them from collapsing.

Referring to FIGS. 3 to 5, since the heel counter 4 is not resilient, a user has to pull the heel portion of the upper 1 by fingers to hold the heel portion of the upper 1 in a normal position when putting the heel of the user into the sockliner 2, or the user has to use a shoehorn (not shown), so as to prevent the heel portion of the upper 1 from collapsing. However, it is inconvenient for the user while wearing shoes. When the user can't be bothered to hold the heel portion of the upper 1 in the normal position, or when there is no shoehorn for use, the user may directly step on the heel portion of the upper 1, which causes the heel portion of the upper 1 and the heel counter 4 to collapse and deform in the long run.

SUMMARY

Therefore, an object of the disclosure is to provide a shoe having a resilient heel that can alleviate at least one of the drawbacks of the prior art.

According to the disclosure, the shoe includes a sole unit, an upper unit, a sockliner unit, a heel counter, and an adhesive layer. The sole unit includes a sole heel sidewall. The upper unit is disposed on the sole unit, defines an inner space having an access opening, and has an access opening edge surrounding the access opening, and an upper heel portion abutting against the sole heel sidewall. The sockliner unit is disposed in the inner space, defines an accommodating space that is open at a top end of the accommodating space to be in spatial communication with the access opening and that is closed at a bottom end of the accommodating space, and has a sockliner heel portion that corresponds to the upper heel portion. The heel counter is resiliently deformable, is disposed between the upper heel portion and the sockliner heel portion, and includes a resilient heel plate. The resilient heel plate has a pressing portion, and two wing portions that respectively extend from two opposite sides of the pressing portion. The pressing portion has a pressing body top edge that is adjacent to the access opening edge, and a pressing body bottom edge that is adjacent to the sole unit. The pressing body bottom edge is lower than a top edge of the sole heel sidewall along a height direction. The adhesive layer is fixedly connected between an inner surface of the upper unit and an outer surface of the sockliner unit.

BRIEF DESCRIPTION OF THE DRAWINGS

Other features and advantages of the disclosure will become apparent in the following detailed description of the embodiment(s) with reference to the accompanying drawings. It is noted that various features may not be drawn to scale.

DETAILED DESCRIPTION

Figure 1:
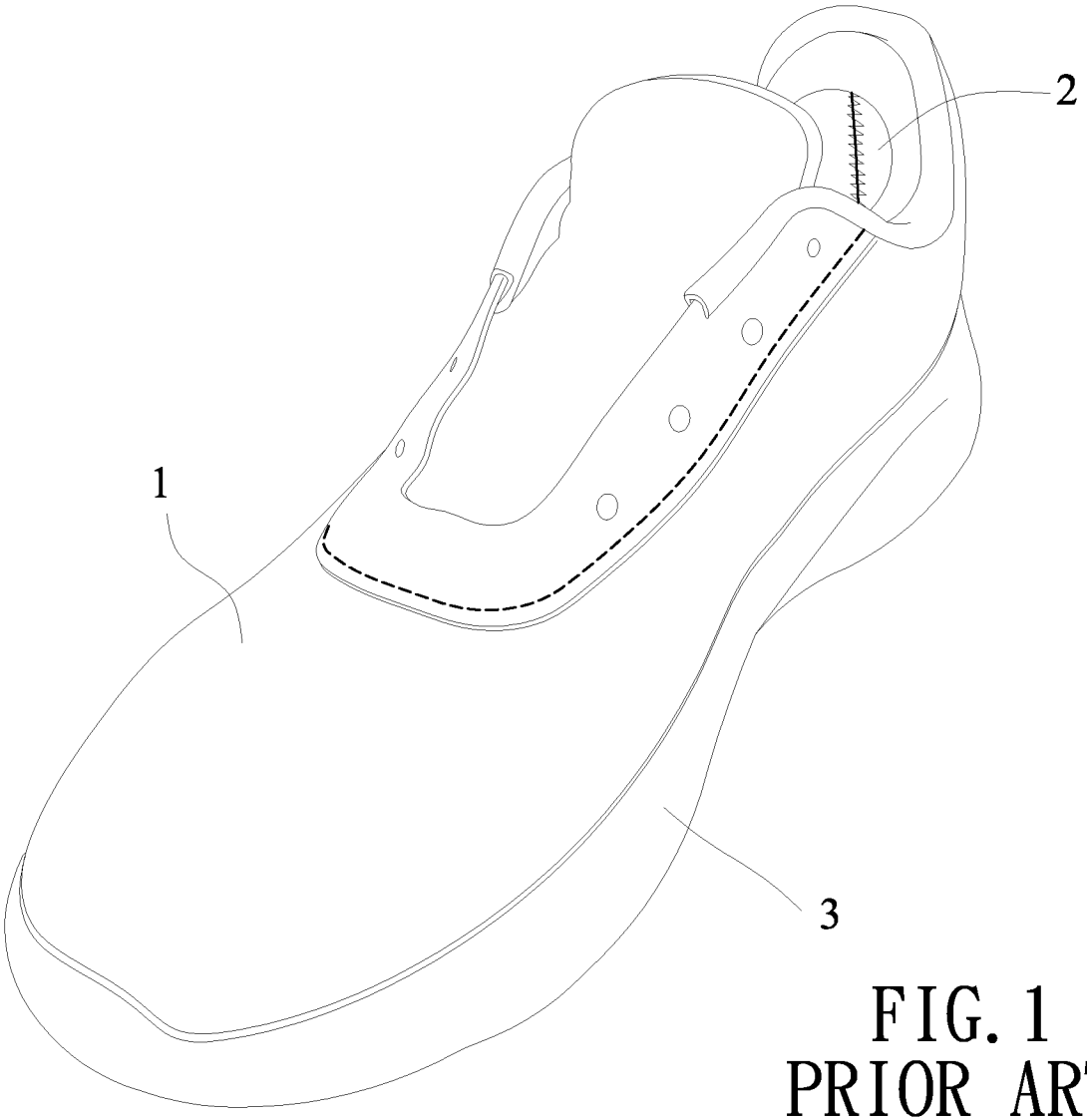
FIG. 1 PRIOR ART
FIG. 1 is a perspective view illustrating a conventional shoe.
Figure 2:
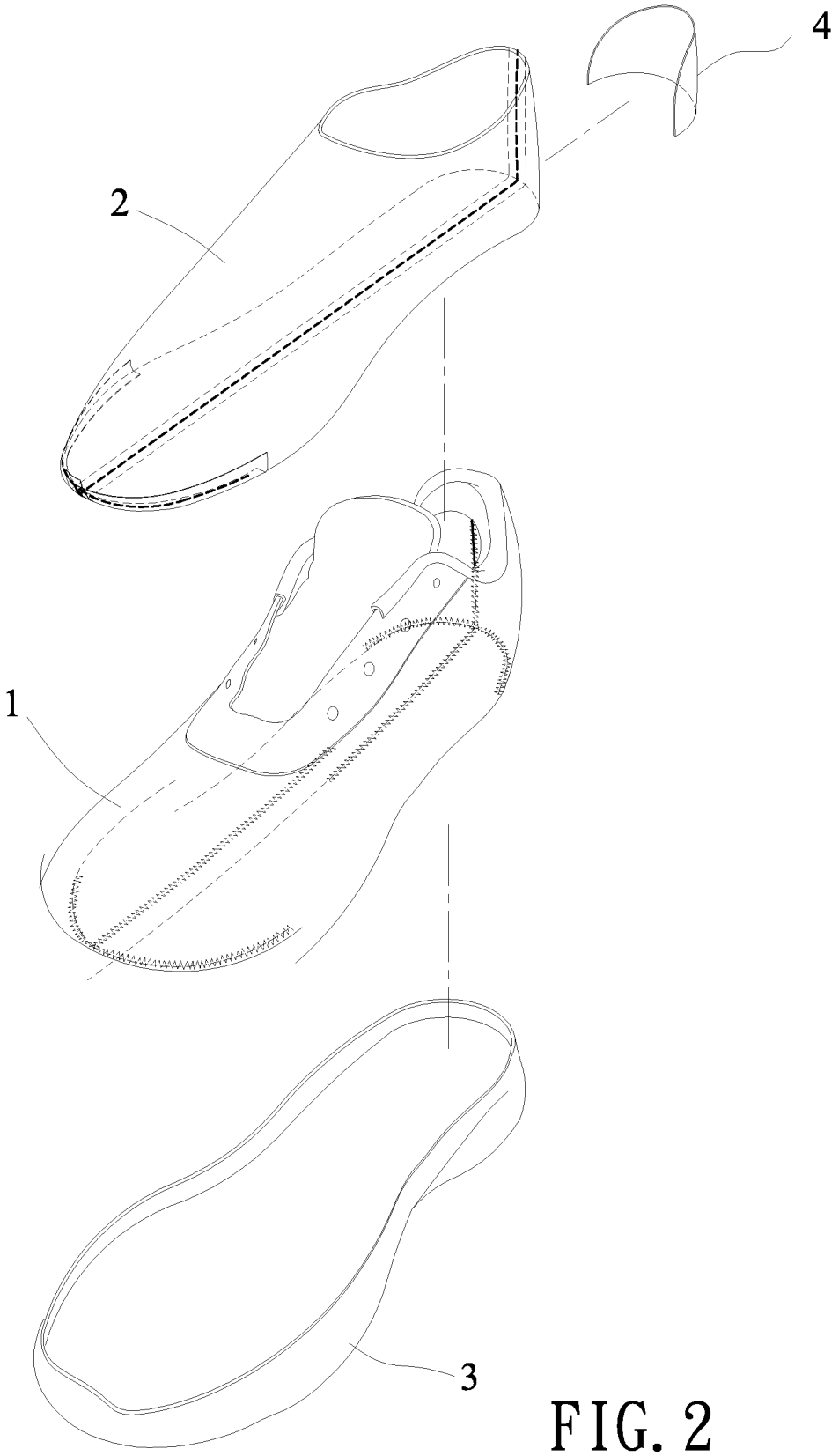
FIG. 2 PRIOR ART
FIG. 2 is an exploded perspective view of the conventional shoe.
Figure 3:
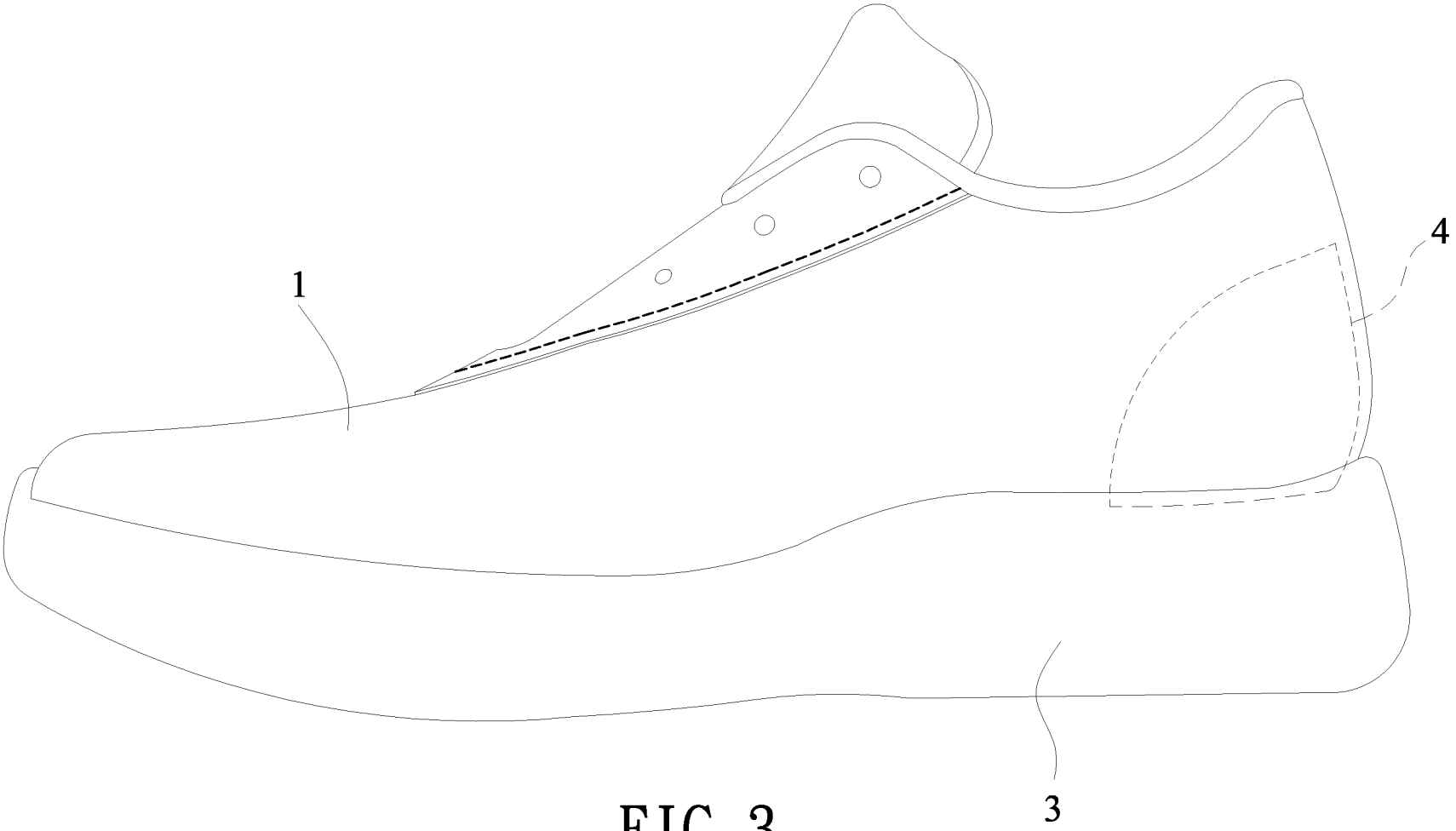
FIG. 3 PRIOR ART
FIG. 3 is a side view of the conventional shoe, illustrating a heel portion of an upper in a normal position.
Figure 4:
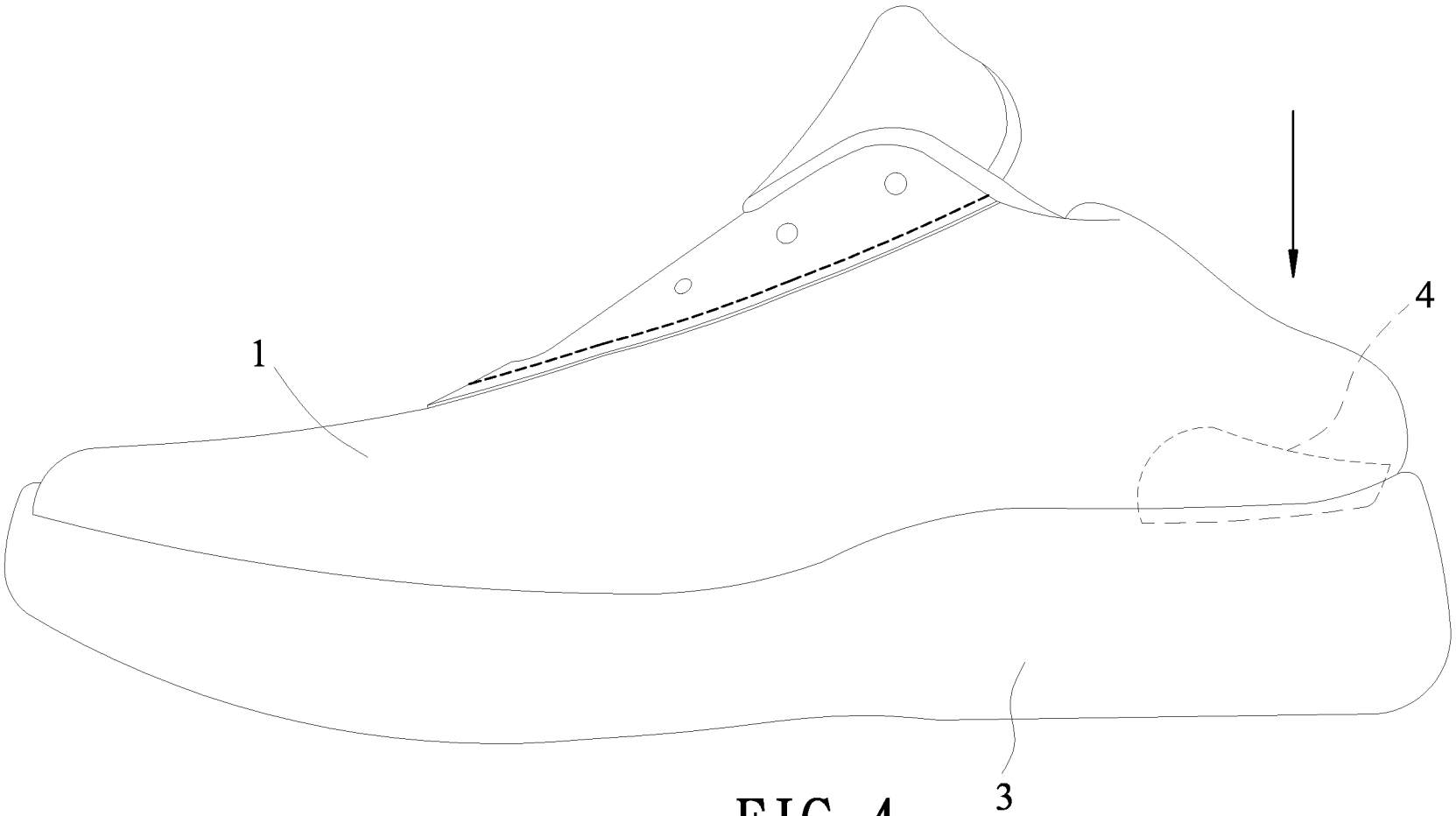
FIG. 4 PRIOR ART
FIG. 4 is similar to FIG. 3, but illustrating the heel portion of the upper and a heel counter of the conventional shoe being stepped.
Figure 5:
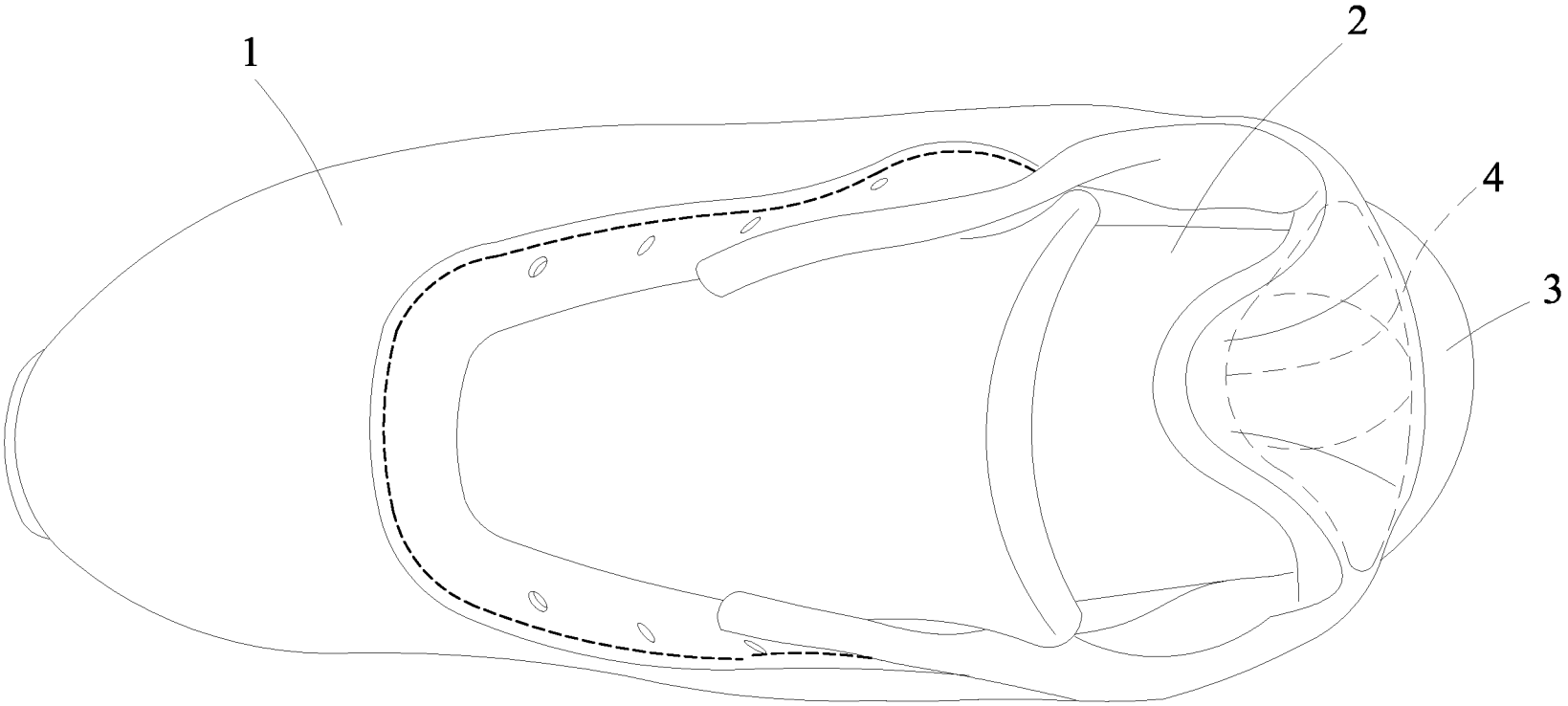
FIG. 5 PRIOR ART
FIG. 5 is a top view of FIG. 4.

Before the disclosure is described in greater detail, it should be noted that where considered appropriate, reference numerals or terminal portions of reference numerals have been repeated among the figures to indicate corresponding or analogous elements, which may optionally have similar characteristics.

It should be noted herein that for clarity of description, spatially relative terms such as "top," "bottom," "upper," "lower," "on," "above," "over," "downwardly," "upwardly" and the like may be used throughout the disclosure while making reference to the features as illustrated in the drawings. The features may be oriented differently (e.g., rotated 90 degrees or at other orientations) and the spatially relative terms used herein may be interpreted accordingly.

Figure 6:
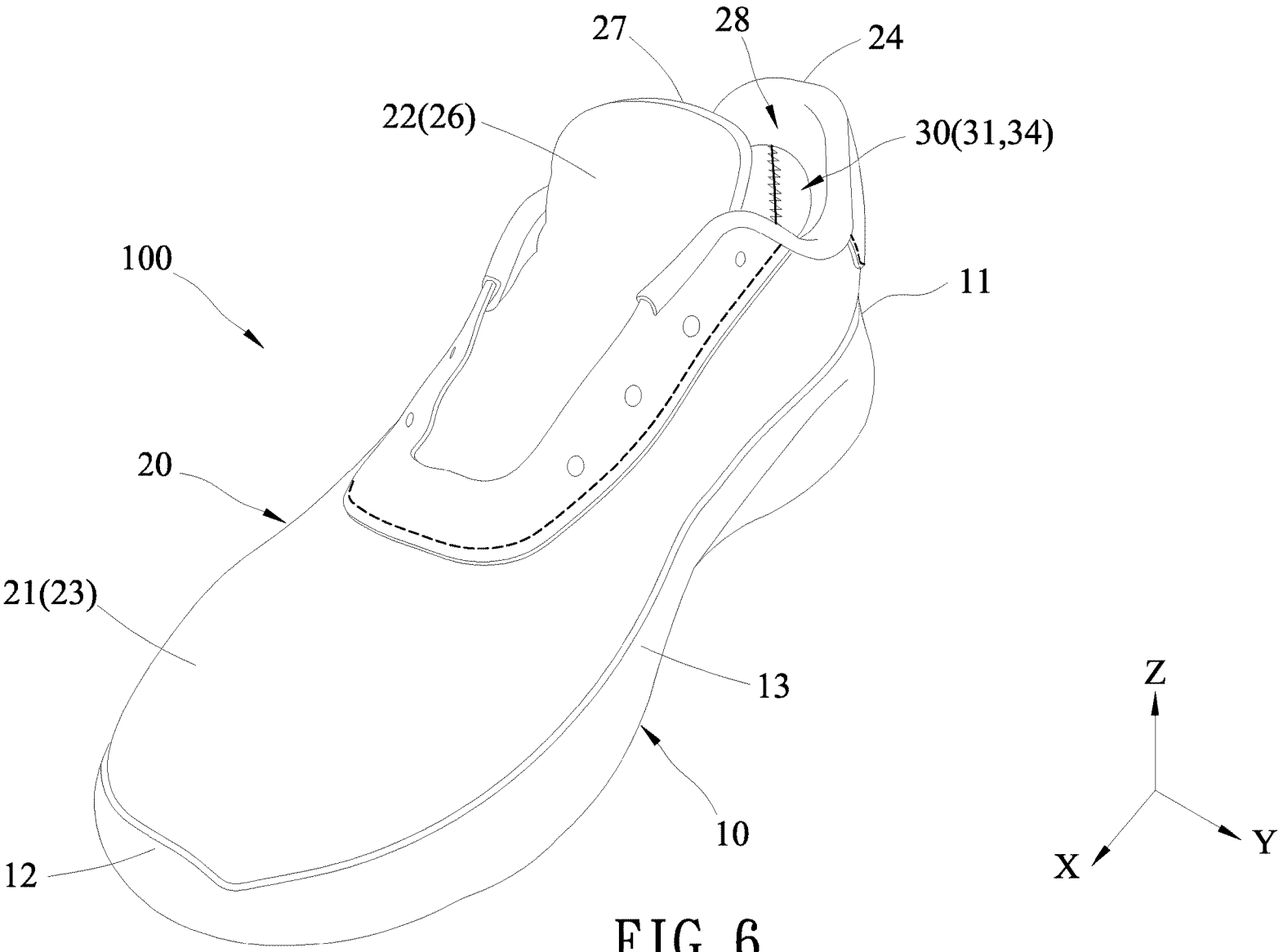
FIG. 6 is a perspective view illustrating an embodiment of a shoe having a resilient heel according to the present disclosure.
Figure 7:
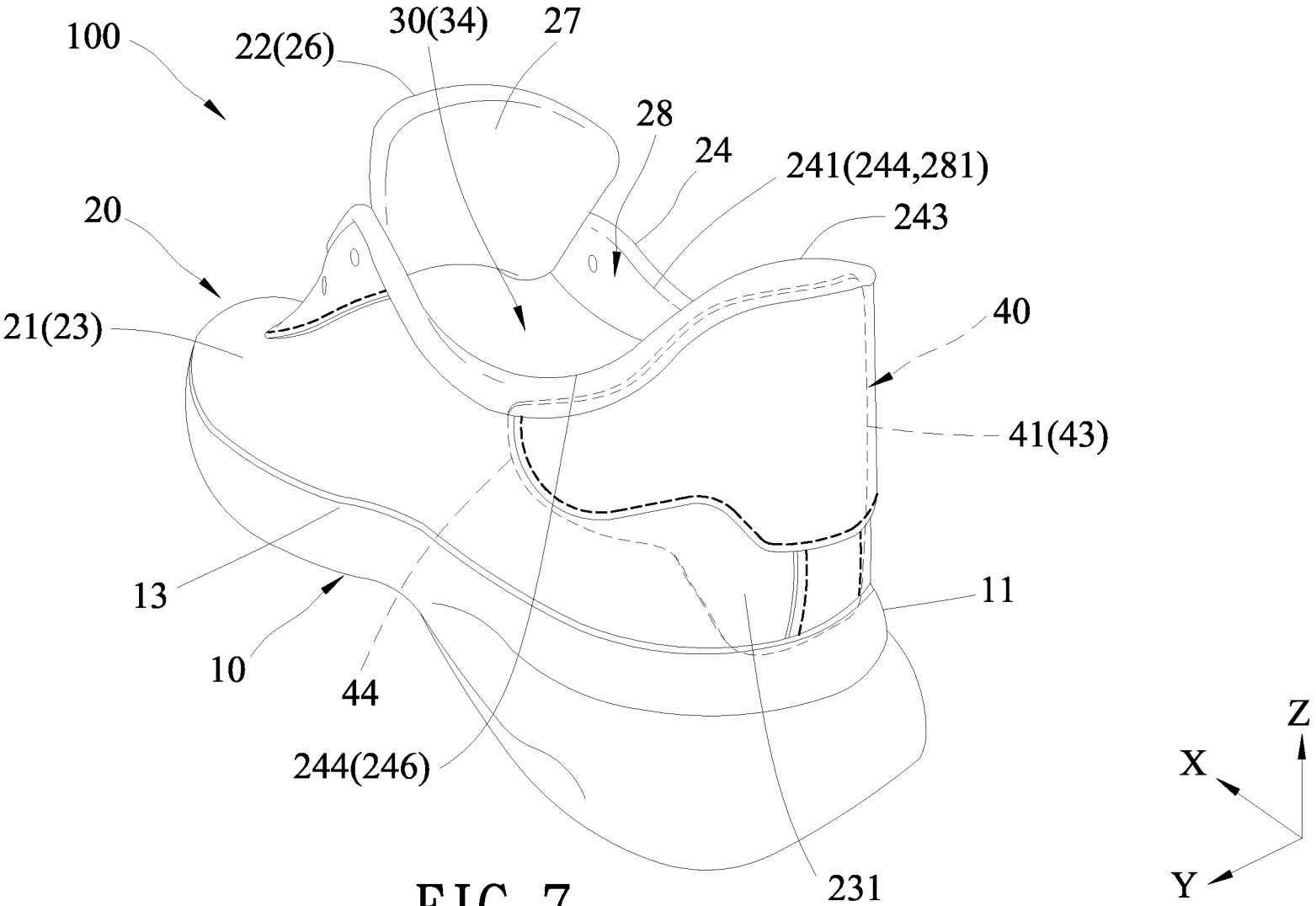
FIG. 7 is a perspective view of the embodiment viewed from a different angle.
Figure 8:
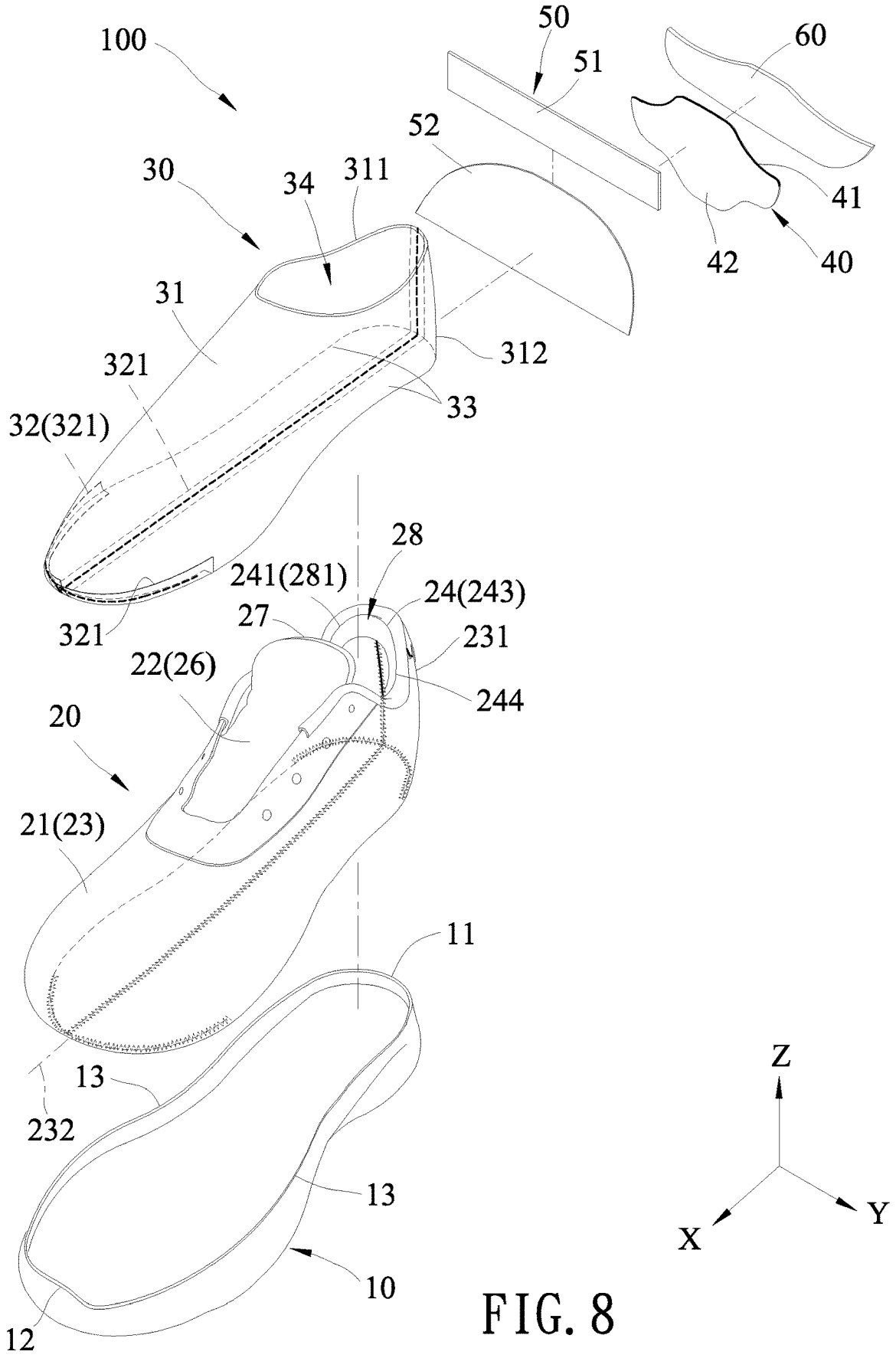
FIG. 8 is an exploded perspective view of the embodiment.
Figure 13:
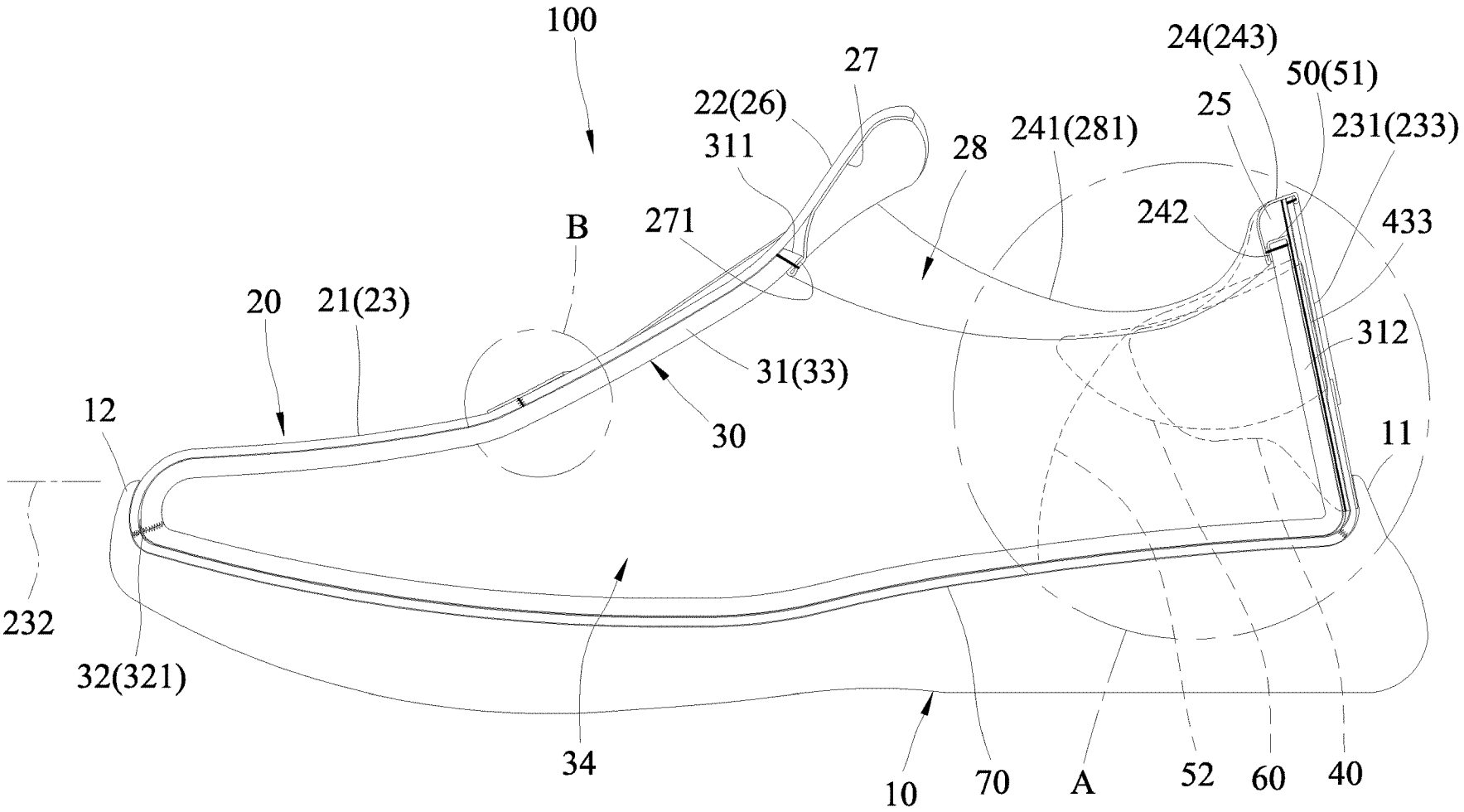
FIG. 13 is a schematic sectional view of the embodiment.

Referring to FIGS. 6 to 8, an embodiment of a shoe 100 having a resilient heel according to the present disclosure includes a sole unit 10, an upper unit 20, a sockliner unit 30, a heel counter 40, a separating unit 50, a heel cushion piece 60 and an adhesive layer 70 (see FIG. 13).

The sole unit 10 includes a sole heel sidewall 11, a sole tiptoe sidewall 12, and two sole connecting sidewalls 13 that are connected between the sole heel sidewall 11 and the sole tiptoe sidewall 12.

Figure 9:
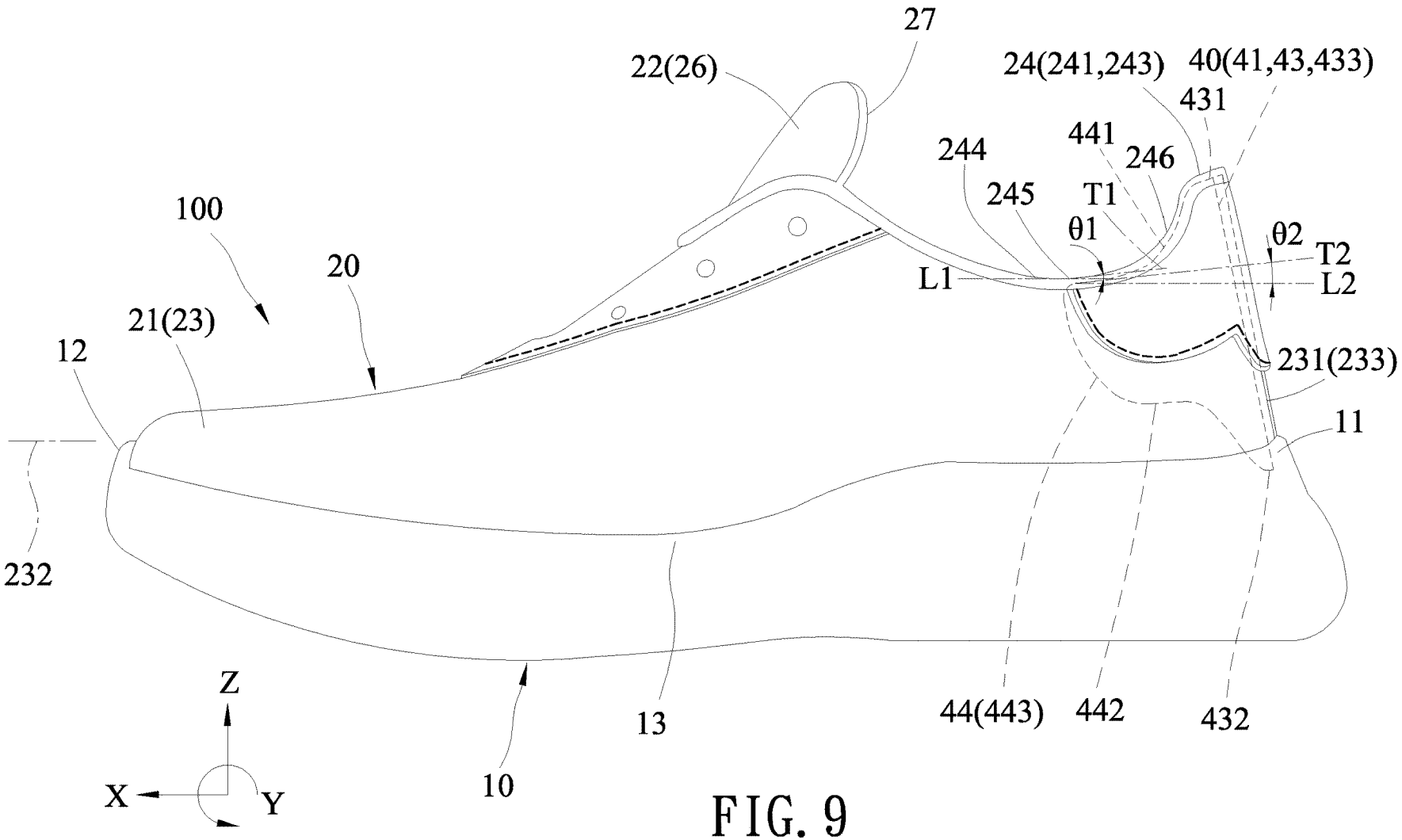
FIG. 9 is a side view of the embodiment.
Figure 10:
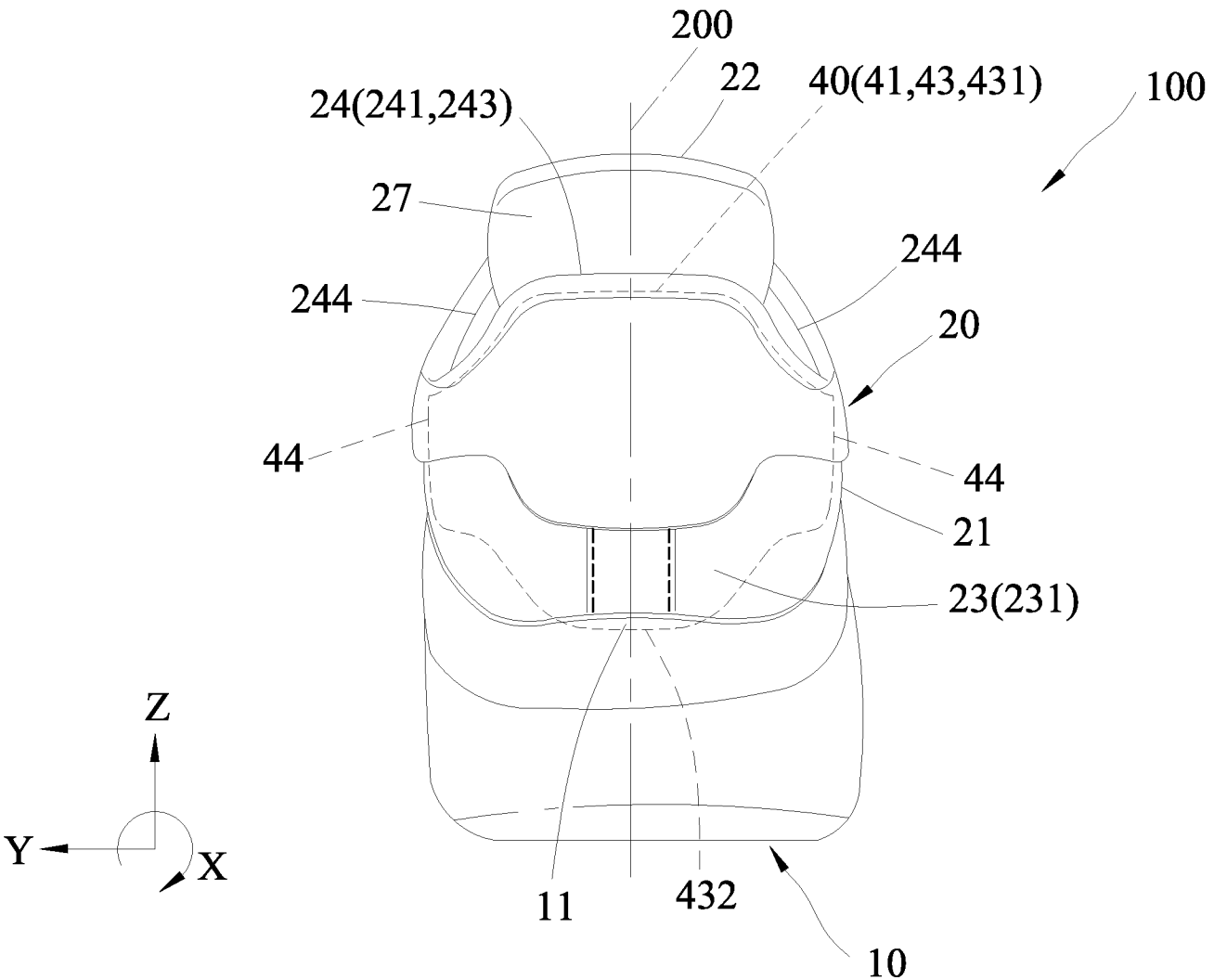
FIG. 10 is a rear view of the embodiment.

Referring to FIGS. 8 to 10, the upper unit 20 is disposed on the sole unit 10, and includes a main upper 21, and a tongue 22 that is disposed on an instep portion of the main upper 21. The main upper 21 has an outer shell 23, a collar lining 24 that is sewed on the outer shell 23, and a collar pad 25 that is embedded between the outer shell 23 and the collar lining 24 (see FIG. 14). The tongue 22 has a tongue part 26, and a tongue lining 27 that is sewed on the tongue part 26. The upper unit 20 defines an inner space 28 having an access opening 281.

The outer shell 23 has an upper heel portion 231 that abuts against the sole heel sidewall 11, and a center line 232 that extends along a length direction (X). The upper heel portion 231 has an upper heel rear contour 233 at a location where the upper heel portion 231 intersects with a reference plane 200 that extends along a height direction (Z) and the length direction (X) (see FIGS. 10 and 14). The center line 232 lies on the reference plane 200. The upper heel rear contour 233 has a linear shape and inclines forwardly and upwardly (see FIG. 14).

Figure 14:
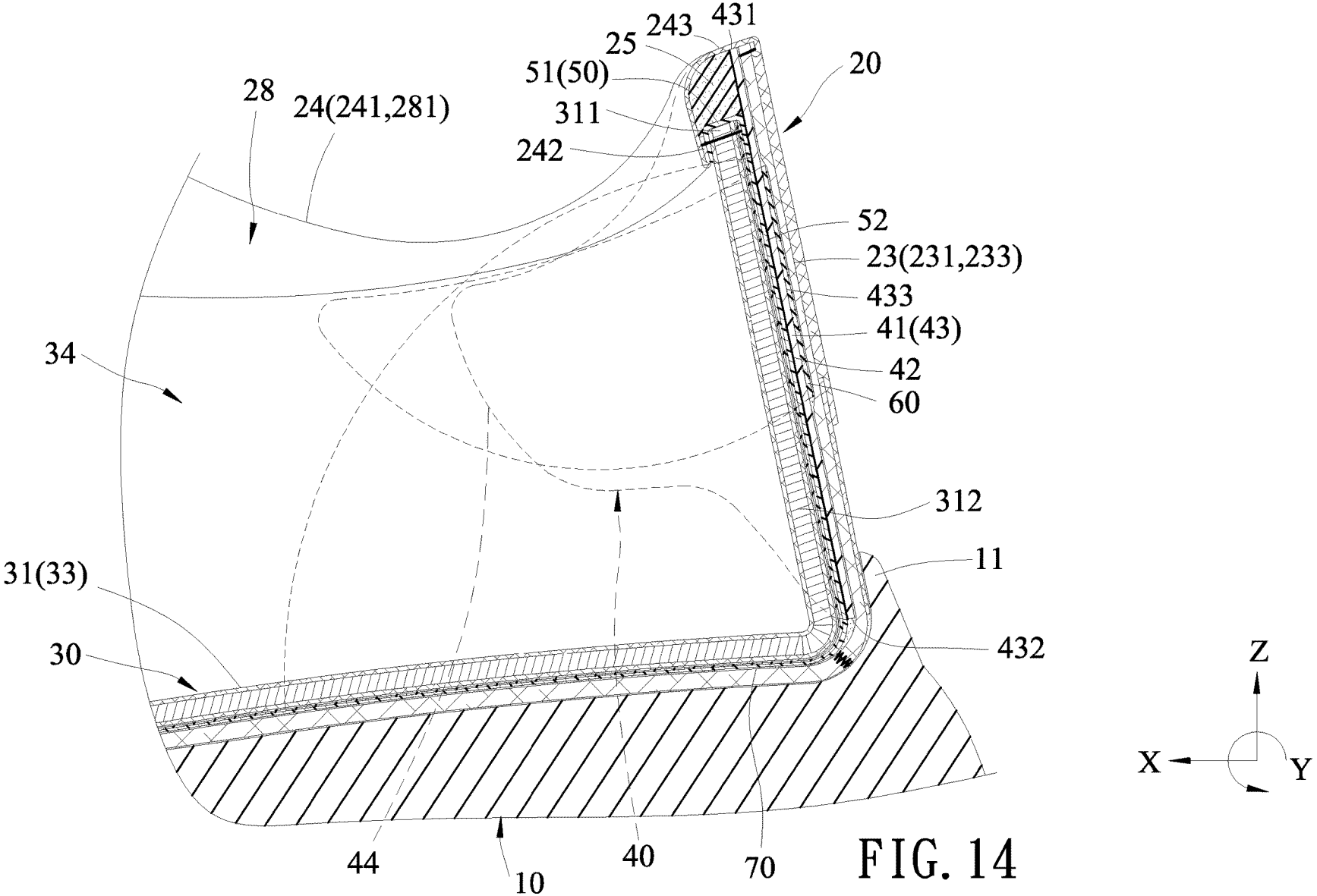
FIG. 14 is an enlarged fragmentary sectional view of Section A in FIG. 13.

The collar lining 24 has an access opening edge 241 that surrounds the access opening 281, and a collar lining bottom portion 242 that extends downwardly from the access opening edge 241 (see FIGS. 13 and 14).

The access opening edge 241 has an upper topmost segment 243, and two upper concave segments 244 that extend respectively and forwardly from two opposite ends of the upper topmost segment 243. Each of the upper concave segments 244 has a lowest point 245, and an upper rear arc part 246 that is connected between the lowest point 245 and the upper topmost segment 243. A first inclined angle (θ1) between a first horizontal reference line (L1) that passes through the lowest point 245 along the length direction (X) and a first tangent line (T1) that passes through the lowest point 245 and that is tangent to the upper rear arc part 246 is not greater than 30 degrees.

Referring to FIGS. 8, 13 and 14, the sockliner unit 30 is disposed in the inner space 28, and is breathable and waterproof. The sockliner unit 30 includes a sockliner 31 and a waterproof accessary 32.

The sockliner 31 has a sockliner top end portion 311 that is loop-shaped, and a sockliner heel portion 312 that corresponds to the upper heel portion 231. The sockliner 31 defines an accommodating space 34 that is open at a top end of the accommodating space 34 to be in spatial communication with the access opening 281 and that is closed at a bottom end of the accommodating space 34. The sockliner top end portion 311 is located at the top end of the accommodating space 34, and extends upwardly from the sockliner heel portion 312.

The tongue lining 27 has a tongue lining bottom portion 271 that extends downwardly to the accommodating space 34 (see FIG. 13).

Figure 15:
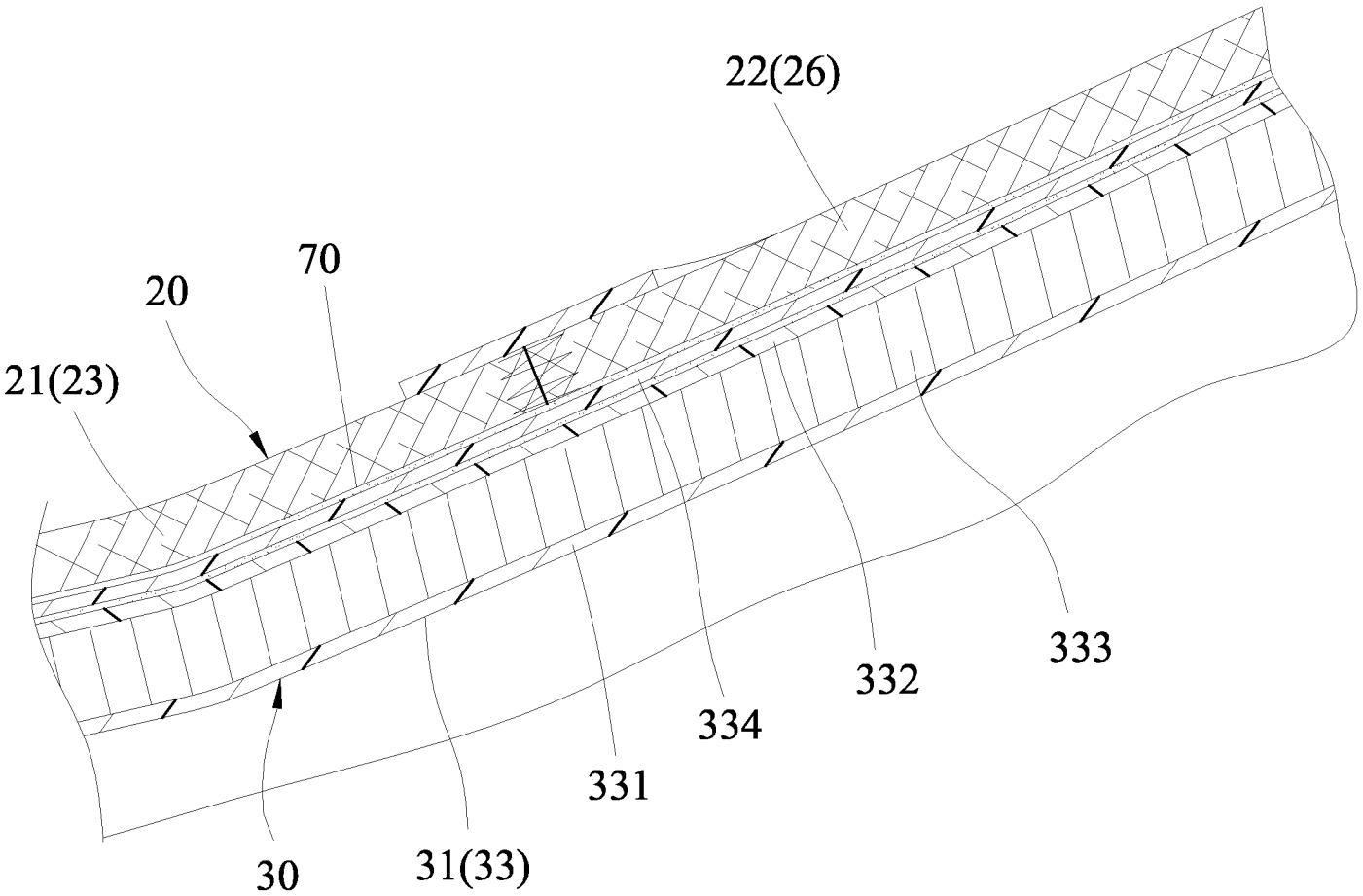
FIG. 15 is an enlarged fragmentary sectional view of Section B in FIG. 13.

In the embodiment, the sockliner 31 is made by sewing together tailored sockliner pieces 33. As shown in FIG. 15, each of the tailored sockliner pieces 33 includes a lining fabric layer 331, a cover fabric layer 332, a supporting layer 333 that is disposed between the lining fabric layer 331 and the cover fabric layer 332, and a breathable waterproof layer 334 that is fixedly disposed on an outer surface of the cover fabric layer 332.

In the embodiment, the supporting layer 333 is an upright plush layer that is sewed between the lining fabric layer 331 and the cover fabric layer 332, but is not limited thereto. In other embodiment, the supporting layer 333 may be a foam layer.

The waterproof accessory 32 has a plurality of waterproof strips 321. The waterproof strips 321 are fixedly connected to an outer surface of the sockliner 31 so as to seal sewing seams of the sockliner 31.

In the embodiment, the collar lining bottom portion 242 of the collar lining 24 extends downwardly from the access opening edge 241 to the accommodating space 34, and the tongue lining bottom portion 271 of the tongue lining 27 extends downwardly to the accommodating space 34. The collar lining bottom portion 242 is folded outwardly and sewed with the sockliner top end portion 311, and the tongue lining bottom portion 271 is folded outwardly and sewed with the sockliner top end portion 311. The collar lining bottom portion 242 of the collar lining 24 and the tongue lining bottom portion 271 of the tongue lining 27 are connected to each other, and cooperatively cover and surround the sockliner top end portion 311 of the sockliner 31.

Referring to FIGS. 9 and 10, the heel counter 40 is resiliently deformable, and is disposed between the upper heel portion 231 and the sockliner heel portion 312 (see FIG. 14).

Figure 11:
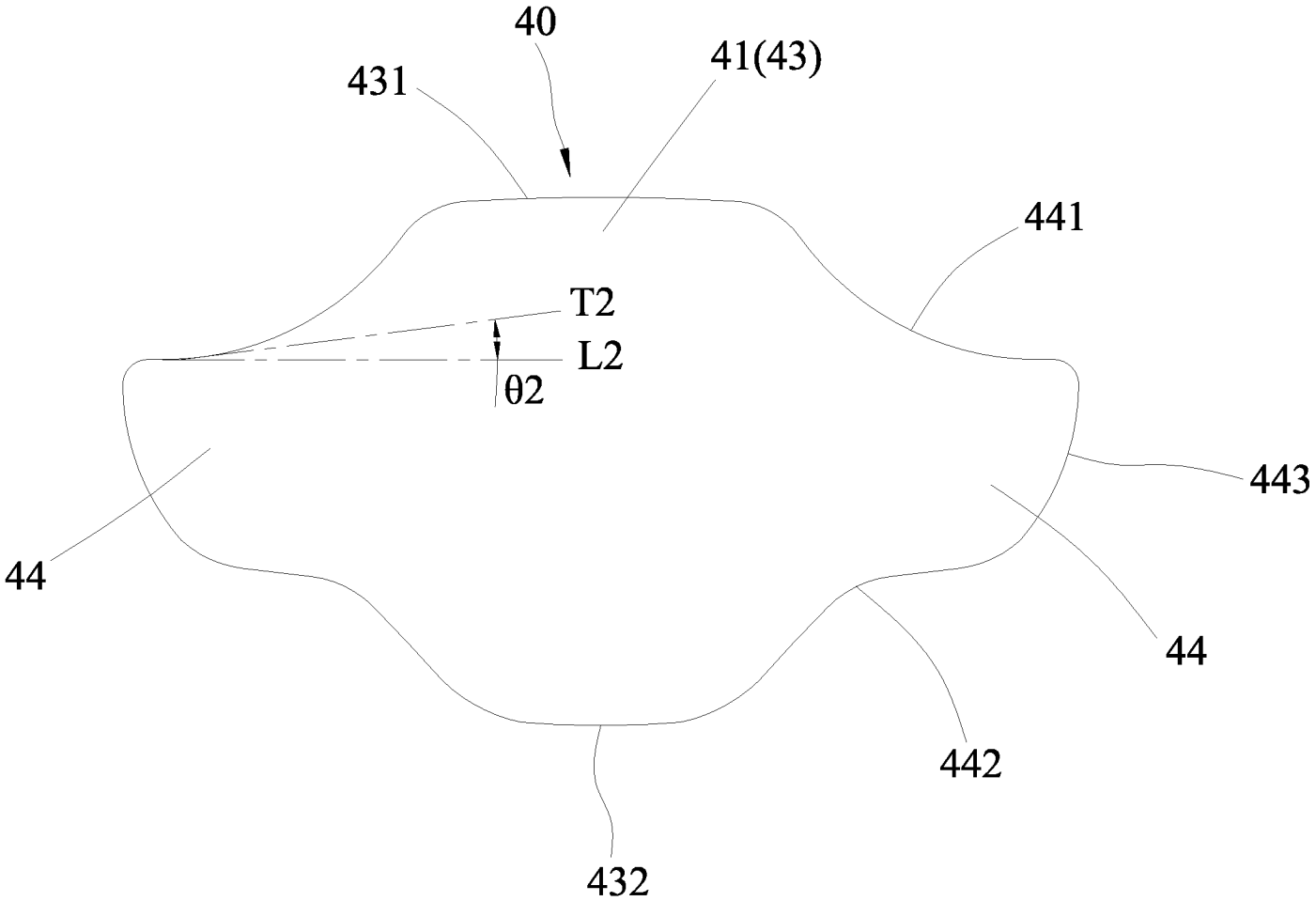
FIG. 11 is a schematic view of a heel counter of the embodiment being unfolded before assembly of the shoe.
Figure 12:
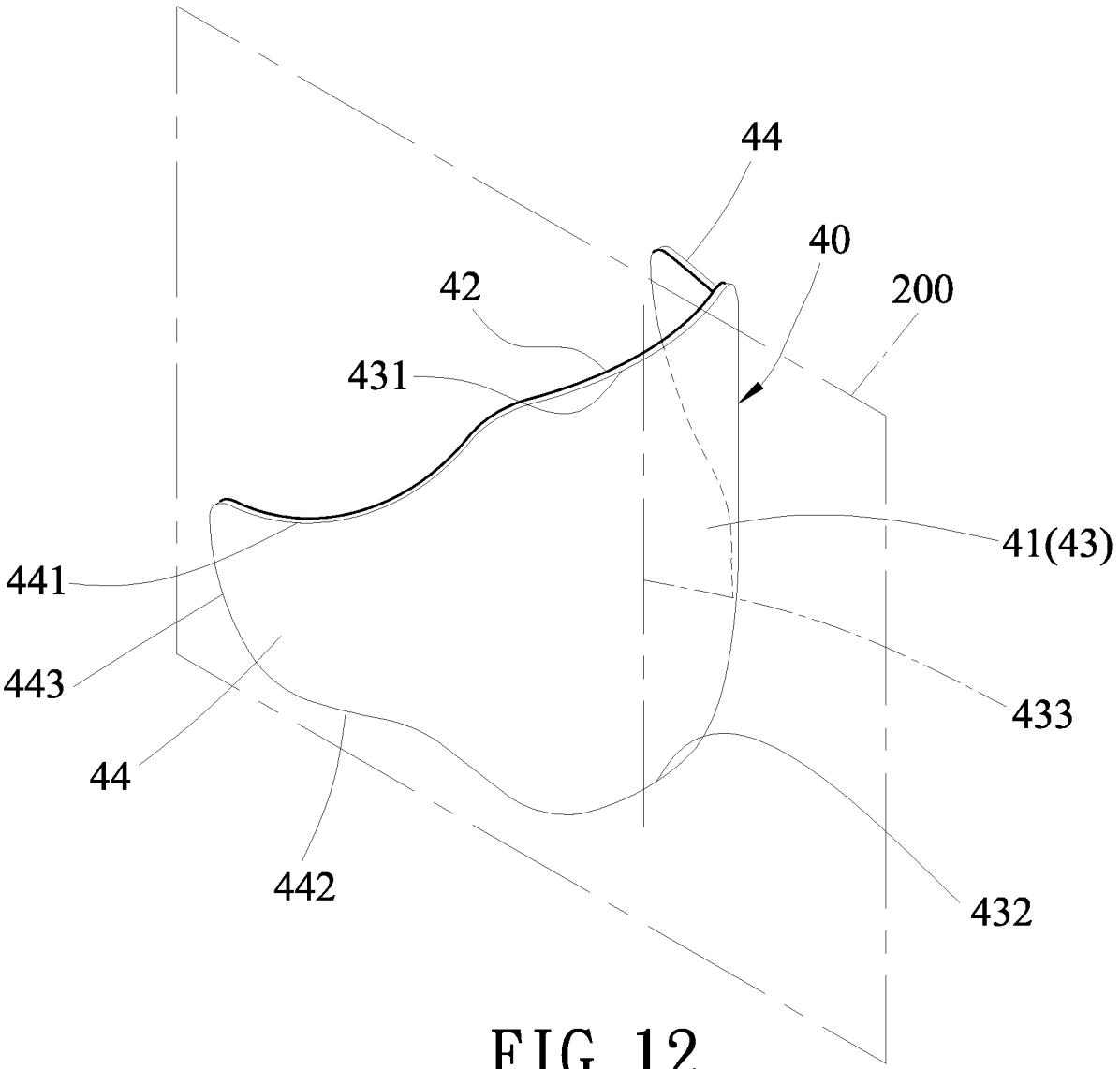
FIG. 12 is a perspective view of the heel counter after the assembly of the shoe.

Referring to FIGS. 11, 12 and 14, the heel counter 40 includes a resilient heel plate 41, and a hot-melt adhesive (HMA) layer 42 that is disposed on an inner surface of the resilient heel plate 41.

The resilient heel plate 41 has a pressing portion 43, and two wing portions 44 that respectively extend from two opposite sides of the pressing portion 43. The pressing portion 43 has a pressing body top edge 431 that is adjacent to the access opening edge 241, and a pressing body bottom edge 432 that is adjacent to the sole unit 10. The pressing body bottom edge 432 is lower than a top edge of the sole heel sidewall 11 along the height direction (Z). The resilient heel plate 41 has a Shore Durometer that ranges from 90 HA to 98 HA. In this embodiment, the upper topmost segment 243 of the access opening edge 241 is higher than the pressing body top edge 431 of the pressing portion 43 along the height direction (Z), and the pressing body top edge 431 extends upwardly to the upper topmost segment 243. The resilient heel plate 41 is made of a thermoplastic polyurethane (TPU) material, and a thickness of the resilient heel plate 41 is 1.5 mm.

The pressing portion 43 of the resilient heel plate 41 has a heel counter rear contour 433 that is formed at a location where the resilient heel plate 41 intersects with the reference plane 200 (see FIG. 12). The heel counter rear contour 433 has a linear shape and inclines forwardly and upwardly from the pressing body bottom edge 432 to the pressing body top edge 431. The upper heel rear contour 233 corresponds to the heel counter rear contour 433.

Referring to FIGS. 9, 11 and 12, each of the wing portions 44 of the heel counter 40 has a wing top arc edge 441 that is connected to the pressing body top edge 431 of the pressing portion 43, a wing bottom arc edge 442 that is connected to the pressing body bottom edge 432 of the pressing portion 43, and a wing side connecting edge 443 that is connected between the wing top arc edge 441 and the wing bottom arc edge 442. A second tangent line (T2) that passes through a junction between the wing top arc edge 441 and the wing side connecting edge 443 and that is tangent to the wing top arc edge 441 is inclined to a second horizontal reference line (L2) that passes in the length direction (X) through the junction between the wing top arc edge 441 and the wing side connecting edge 443 by a second inclined angle (82). The second inclined angle (02) is not greater than degrees, and the first inclined angle (θ1) corresponds to the second inclined angle (82).

Referring to FIGS. 9, 10 and 14, owing to the configuration of the heel counter 40, the heel counter 40 may not only support the upper heel portion 231 of the outer shell 23 and the sockliner heel portion 312 of the sockliner 31, but the upper topmost segment 243 of the access opening edge 241 of the collar lining 24 and the upper rear arc parts 246 of the upper concave segments 244, such that the upper heel rear contour 233 corresponding to the heel counter rear contour 433, and the first inclined angle (θ1) corresponding to the second inclined angle (θ2), are maintained.

Referring to FIGS. 8, 13 and 14, the separating unit 50 is disposed between and separates the sockliner heel portion 312 of the sockliner unit 30 and the HMA layer 42 of the heel counter 40. The HMA layer 42 of the heel counter 40 is stuck to the separating unit 50.

In this embodiment, the separating unit 50 includes a top separating foam piece 51 that is disposed on the sockliner heel portion 312 and that covers the sockliner top end portion 311, and a bottom separating piece 52 that is disposed on the sockliner heel portion 312 and that is below the top separating foam piece 51. The separating foam piece 51 is bent to partially cover the sockliner top end portion 311, and extends to the accommodating space 34. The bottom separating piece 52 is made of a TPU material, and has a thickness ranging from 0.8 mm to 1 mm. It should be noted that, the top separating foam piece 51 and the bottom separating piece 52 can prevent the HMA layer 42 of the heel counter 40 from being directly stuck to the breathable waterproof layers 334 of the tailored sockliner pieces 33 of the sockliner 31, and thereby the breathable waterproof layers 334 may not be broken (owing to material properties of the sockliner 30 and the heel counter 40 being different) when the heel counter 40 deforms, so as to increase durability of the shoe 100. In some embodiments, the bottom separating piece 52 may be sewed to the sockliner top end portion 311. In addition, the top separating foam piece 51 can prevent the HMA layer 42 of the heel counter 40 from flowing inside of the sockliner 30, avoiding aesthetic problems.

The heel cushion piece 60 is disposed between the separating unit 50 and the upper heel portion 231 of the upper unit 20, and in this embodiment, the heel cushion piece 60 is made of a foam material.

As shown in FIGS. 13 to 15, the adhesive layer 70 is fixedly connected between an inner surface of the upper unit 20 and an outer surface of the sockliner unit 30.

Figure 16:
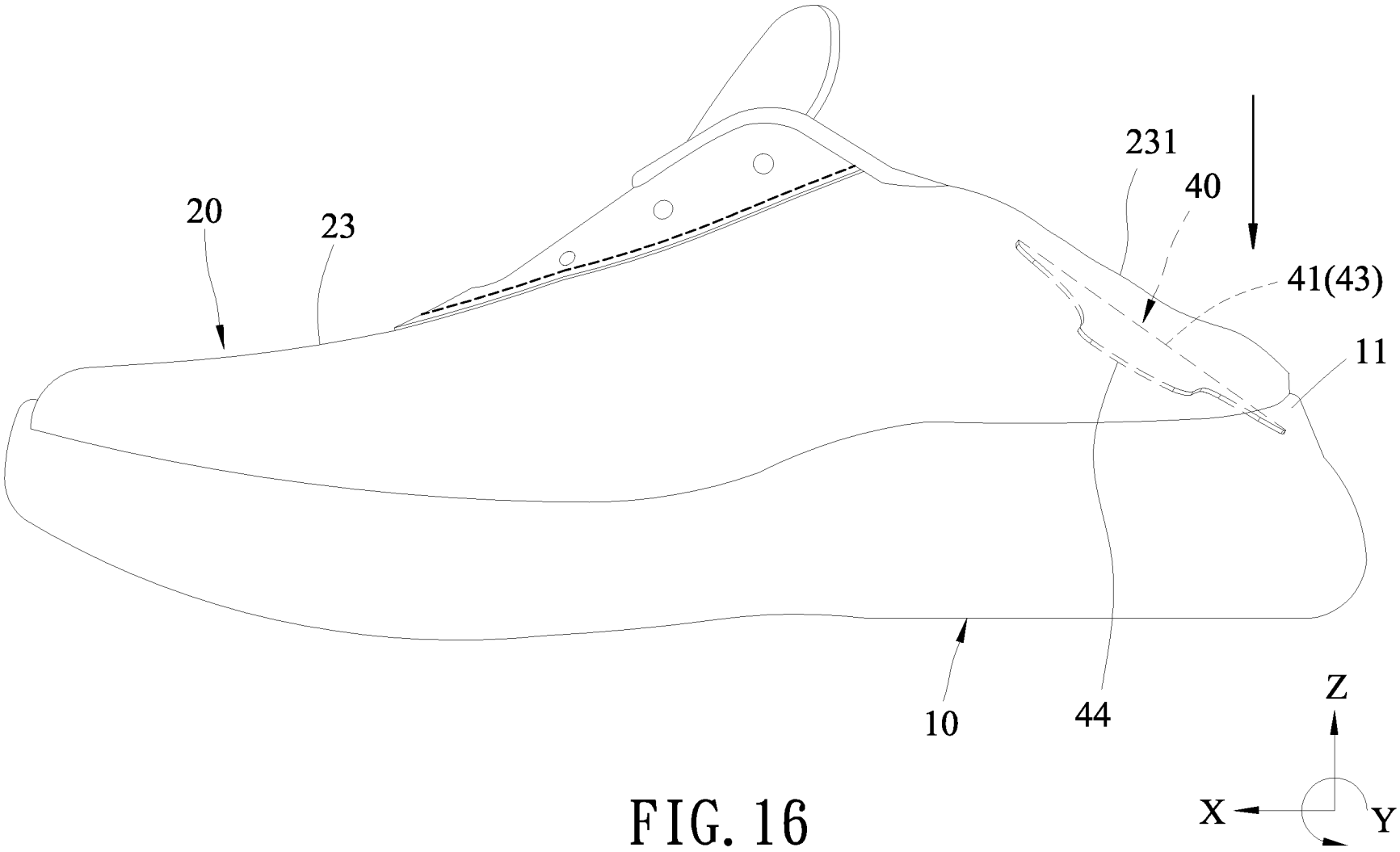
FIG. 16 is similar to FIG. 9, illustrating an upper heel portion of an upper unit of the embodiment being stepped.
Figure 17:
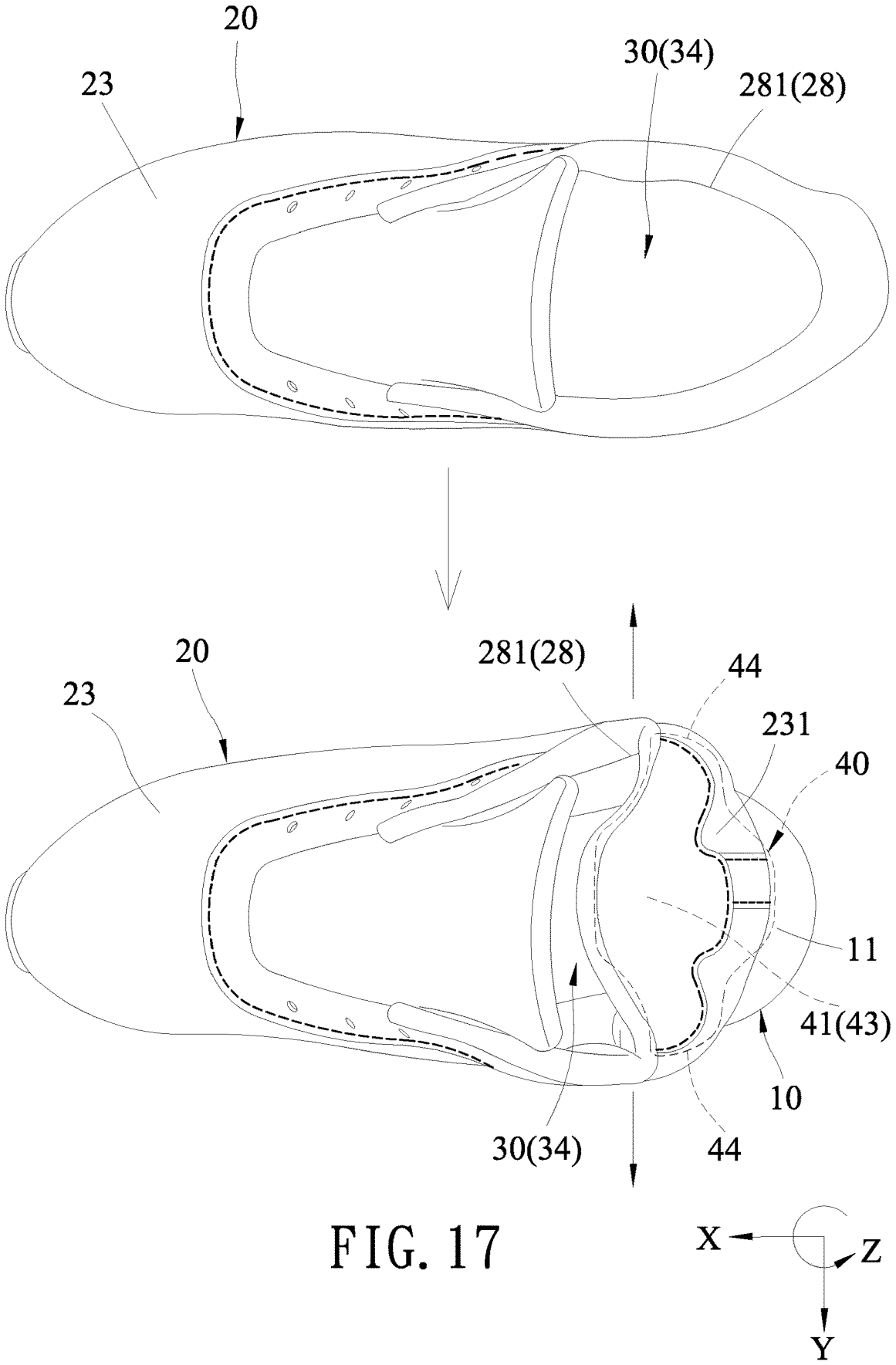
FIG. 17 is a top view of the embodiment, illustrating an access opening of the upper unit being expanded by the heel counter when the upper heel portion of the upper unit is stepped.

Referring to FIGS. 13, 16 and 17, when the user is wearing the shoe 100, the user puts a front portion of the foot (not shown) into the accommodating space 34 of the sockliner 31 of the sockliner unit 30, and directly steps on the upper heel portion 231 of the outer shell 23 of the upper unit 20 by a heel portion of the foot (not shown) of the user. During the process, the pressing portion 43 of the resilient heel plate 41 of the heel counter 40 abuts against the sole heel sidewall 11 of the sole unit 10 and is inclined downwardly. At the same time, the access opening 281 of the inner space 28 of the upper unit 20 is flared by the wing portions 44 of the resilient heel plate 41 along a horizontal direction (Y), so it is convenient for the user to put the heel portion of the foot into the accommodating space 34 of the sockliner 31 of the sockliner unit 30. When the user slightly lifts the heel portion of the foot, a resilient force of the resilient heel plate 41 drives the upper heel portion 231 of the outer shell 23 of the upper unit 20 to restore to an original state shown in FIG. 9, which allows the user to easily wear the shoe 100 without bending over and using hands and the shoehorn.

The effects of the present disclosure are as follows:

1. By virtue of the design of the heel counter 40 and the sole heel sidewall 11 of the sole unit 10, the user may easily wear the shoe 100 by the resilient force of the heel counter 40 to automatically make the upper heel portion 231 of the outer shell 23 of the upper unit 20 to restore to the original state without bending over and using hands and the shoehorn. Compared to the prior art, it is not only convenient, but effectively prevents the upper heel portion 231 of the outer shell 23 of the upper unit 20 from collapsing and deforming due to stepping of the user.

2. The design of the separating unit 50 and the heel counter 40 prevents the HMA layer 42 of the heel counter 40 from being directly stuck to the breathable waterproof layers 334 of the tailored sockliner pieces 33 of the sockliner 31, and thereby the breathable waterproof layers 334 may not be broken, owing to material properties of the sockliner 30 and the heel counter 40 being different when the heel counter 40 deforms, so as to increase durability of the shoe 100. In addition, the top separating foam piece 51 can prevent the HMA layer 42 of the heel counter 40 from flowing inside of the sockliner 30, avoiding aesthetic problems.

3. By virtue of the design of the heel cushion piece 60 and the heel counter 40, a cushioning effect is generated between the heel counter 40 and the heel portion of the foot of the user when the user steps on the upper heel portion 231 of the outer shell 23 of the upper unit 20, allowing the user to have a better shoe-wearing experience.

4. By virtue of the collar lining bottom portion 242 of the collar lining 24 being folded outwardly and sewed with the sockliner top end portion 311 of the sockliner 31, and the tongue lining bottom portion 271 of the tongue lining 27 being folded outwardly and sewed with the sockliner top end portion 311 of the sockliner 31, sewing seams between the collar lining 24 and the sockliner 31 and sewing seams between the tongue lining 27 and the sockliner 31 are covered and hidden, thereby simplifying sewing marks of an inner portion of the disclosure and increasing the texture, and further improving wearing comfort of the user.

To sum up, the shoe 100 having a resilient heel of the present disclosure not only allows the user to easily and conveniently wear the shoe 100 without bending over and using hands and the shoehorn, but prevents the upper heel portion 231 of the outer shell 23 of the upper unit 20 from collapsing and deforming due to stepping of the user. The object of the disclosure is indeed achieved.

In the description above, for the purposes of explanation, numerous specific details have been set forth in order to provide a thorough understanding of the embodiment(s). It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects; such does not mean that every one of these features needs to be practiced with the presence of all the other features. In other words, in any described embodiment, when implementation of one or more features or specific details does not affect implementation of another one or more features or specific details, said one or more features may be singled out and practiced alone without said another one or more features or specific details. It should be further noted that one or more features or specific details from one embodiment may be practiced together with one or more features or specific details from another embodiment, where appropriate, in the practice of the disclosure.

While the disclosure has been described in connection with what is (are) considered the exemplary embodiment(s), it is understood that this disclosure is not limited to the disclosed embodiment(s) but is intended to cover various arrangements included within the spirit and scope of the broadest interpretation so as to encompass all such modifications and equivalent arrangements.

What is claimed is:

1. A shoe having a resilient heel, comprising:

a sole unit that includes a sole heel sidewall;

an upper unit that is disposed on said sole unit, and that defines an inner space having an access opening, said upper unit having an access opening edge that surrounds said access opening, and an upper heel portion that abuts against said sole heel sidewall;

a sockliner unit that is disposed in said inner space, said sockliner unit defining an accommodating space that is open at a top end of said accommodating space to be in spatial communication with said access opening and that is closed at a bottom end of said accommodating space, said sockliner unit having a sockliner heel portion that corresponds to said upper heel portion;

a heel counter that is resiliently deformable, and that is disposed between said upper heel portion and said sockliner heel portion, said heel counter including a resilient heel plate, said resilient heel plate having a pressing portion, and two wing portions that respectively extend from two opposite sides of said pressing portion, said pressing portion having a pressing body top edge that is adjacent to said access opening edge, and a pressing body bottom edge that is adjacent to said sole unit, said pressing body bottom edge being lower than a top edge of said sole heel sidewall along a height direction; and an adhesive layer that is fixedly connected between an inner surface of said upper unit and an outer surface of said sockliner unit;

wherein said upper unit includes a main upper, and a tongue that is disposed on an instep portion of said main upper;

wherein said main upper has an outer shell, a collar lining that is sewed on said outer shell, and a collar pad that is embedded between said outer shell and said collar lining;

wherein said outer shell has said upper heel portion and a center line;

wherein said collar lining has said access opening edge, and further has a collar lining bottom portion that extends downwardly from said access opening edge to said accommodating space;

wherein said tongue has a tongue part, and a tongue lining that is sewed on said tongue part, said tongue lining having a tongue lining bottom portion that extends downwardly to said accommodating space;

wherein said sockliner unit is breathable and waterproof, and includes a sockliner, said sockliner defining said accommodating space, said sockliner having said sockliner heel portion, and further having a sockliner top end portion that is loop-shaped, that is located at said top end of said accommodation space, and that extends upwardly from said sockliner heel portion;

wherein said collar lining bottom portion is folded outwardly and is sewed with said sockliner top end portion; and wherein said tongue lining bottom portion is folded outwardly and is sewed with said sockliner top end portion.

2. The shoe as claimed in claim 1, wherein:

the center line extends along a length direction of the shoe, said pressing portion of said resilient heel plate having a heel counter rear contour that is formed at a location where said resilient heel plate intersects with a reference plane that extends along the height direction and the length direction, the center line lying on the reference plane, said heel counter rear contour having a linear shape and inclining forwardly and upwardly from said pressing body bottom edge to said pressing body top edge, said resilient heel plate having a Shore Durometer that ranges from 90 HA to 98 HA.

3. The shoe as claimed in claim 2, wherein said upper heel portion having an upper heel rear contour at a location where said upper heel portion intersects with the reference plane, said upper heel rear contour having a linear shape and inclining forwardly and upwardly, said upper heel rear contour corresponding to said heel counter rear contour.

4. The shoe as claimed in claim 2, wherein said access opening edge has an upper topmost segment that is higher than said pressing body top edge of said pressing portion along the height direction, and two upper concave segments that extend respectively and forwardly from two opposite ends of said upper topmost segment, each of said upper concave segments having a lowest point, and an upper rear arc part that is connected between said lowest point and said upper topmost segment, a first inclined angle between a first horizontal reference line that passes through said lowest point along the length direction and a first tangent line that passes through said lowest point and that is tangent to said upper rear arc part being not greater than 30 degrees.

5. The shoe as claimed in claim 4, wherein each of said wing portions of said heel counter has a wing top arc edge that is connected to said pressing body top edge of said pressing portion, a wing bottom arc edge that is connected to said pressing body bottom edge of said pressing portion, and a wing side connecting edge that is connected between said wing top arc edge and said wing bottom arc edge, a second tangent line that passes through a junction between said wing top arc edge and said wing side connecting edge and that is tangent to said wing top arc edge being inclined to a second horizontal reference line that passes in the length direction through the junction between said wing top arc edge and said wing side connecting edge by a second inclined angle, the second inclined angle being not greater than 30 degrees, the first inclined angle corresponding to the second inclined angle.

6. The shoe as claimed in claim 1, further comprising a separating unit, said heel counter further including a hot-melt adhesive (HMA) layer that is disposed on an inner surface of said resilient heel plate, said separating unit being disposed between and separating said sockliner heel portion of said sockliner unit and said HMA layer of said heel counter, said HMA layer of said heel counter being stuck to said separating unit.

7. The shoe as claimed in claim 6, wherein:

said separating unit includes a top separating foam piece that is disposed on said sockliner heel portion and that covers said sockliner top end portion, and a bottom separating piece that is disposed on said sockliner heel portion and that is below said top separating foam piece.

8. The shoe as claimed in claim 7, further comprising a heel cushion piece, said heel cushion piece being disposed between said separating unit and said upper heel portion of said upper unit.

9. The shoe as claimed in claim 1, wherein said sockliner unit further includes a waterproof accessory, said sockliner being made by sewing together tailored sockliner pieces, each of said tailored sockliner pieces including a lining fabric layer, a cover fabric layer, a supporting layer that is disposed between said lining fabric layer and said cover fabric layer, and a breathable waterproof layer that is fixedly disposed on an outer surface of said cover fabric layer, said waterproof accessory having a plurality of waterproof strips, said waterproof strips being fixedly connected to an outer surface of said sockliner so as to seal sewing seams of said sockliner.

* * * * *